United States Patent [19]

Roche et al.

[11] Patent Number: 4,553,067

[45] Date of Patent: Nov. 12, 1985

[54] METHOD OF DISPENSING MERCURY INTO A FLUORESCENT LAMP AND LAMP TO OPERATE WITH METHOD

[75] Inventors: William J. Roche, Merrimac; Ralph P. Parks, Jr., Beverly, both of Mass.

[73] Assignee: GTE Products Corporation, Stamford, Conn.

[21] Appl. No.: 658,454

[22] Filed: Oct. 9, 1984

Related U.S. Application Data

[63] Continuation of Ser. No. 347,605, Feb. 10, 1982, abandoned.

[51] Int. Cl.[4] ..... H01J 61/28

[52] U.S. Cl. ..... 313/546; 313/547; 313/550; 445/9; 445/20

[58] Field of Search ..... 313/490, 492, 486, 546, 313/547, 550; 445/9, 21, 38, 53

[56] References Cited

U.S. PATENT DOCUMENTS

| | | | |
|---|---|---|---|
| 1,921,067 | 8/1933 | Bedford | 445/9 |
| 2,930,921 | 3/1960 | Cappelletti et al. | 445/21 X |
| 3,401,296 | 9/1968 | Rigot | 445/21 X |
| 3,657,589 | 4/1972 | Della Porta et al. | 313/490 X |
| 4,427,919 | 1/1984 | Grenfell | 313/546 |

FOREIGN PATENT DOCUMENTS

| | | | |
|---|---|---|---|
| 2056968 | 5/1972 | Fed. Rep. of Germany | 313/490 |
| 2040554 | 8/1980 | United Kingdom | 313/490 |

*Primary Examiner*—David K. Moore
*Assistant Examiner*—Vincent DeLuca
*Attorney, Agent, or Firm*—Carlo S. Bessone; William McNeill

[57] ABSTRACT

Mercury release into a sealed arc discharge lamp is accomplished by positioning a mercury containing target within the lamp and heating the same by electron bombardment derived from a D.C. power supply connected between an electrode of the lamp and the mercury target.

3 Claims, 4 Drawing Figures

METHOD OF DISPENSING MERCURY INTO A FLUORESCENT LAMP AND LAMP TO OPERATE WITH METHOD

This application is a continuation of application Ser. No. 347,605, filed Feb. 10, 1982, now abandoned.

TECHNICAL FIELD

This invention relates to an arc discharge lamps which include mercury and to a method for dispensing the mercury into the lamp. It has particular application to fluorescent lamps.

BACKGROUND ART

In the past, it has been common to dispense liquid mercury into a lamp through an exhaust tubulation. Since this procedure has on occasion been considered an environmental hazard, as well as being wasteful, other techniques, involving the release of mercury from a solid after the lamp has been evacuated and sealed, have been employed.

These other techniques have involved the use of radio frequency (RF) induced currents in order to heat the mercury target. This has required the use of a metal antenna loop in order to intercept and convert the RF energy into an RF heating current.

In one such method the antenna took the form of a disintegration shield encircling the lamp oil. This shield contained an intermetallic $Ti_3$ Hg alloy applied to one side of an oval-shaped ribbon loop made of a base metal such as nickel or stainless steel. The metal ribbon had a width of about 0.25 inches.

Another method of mercury dispensing employing the disintegration shield RF antenna principle was to position the mercury target across a gap in the ribbon shield. The mercury was contained in either a glass or metal capsule. In the case of the glass capsule a fine wire was either wrapped around the capsule or passed through it. The ends of the wire were then welded to each side of the shield gap to complete the loop current path. In the case of the metal capsule, the capsule itself is welded across the gap to complete the loop current path.

Previous dispensing techniques involving metal ribbon shields have relied on the heat generated by the RF current to raise the temperature of the metal loop or the wire or capsule across the shield gap to the level required for mercury release. The required temperature varied depending on the type of mercury target. The $Ti_3$ Hg alloy releases mercury by thermal decomposition within a temperature range of 600° C. to 1000° C. The release time will be lower at the higher temperature. A release time of 25 seconds is achieved for a temperature of 900° C. In the case of the glass capsule, the wire temperature required to crack the glass is about 1000° C., and Hg release times are between 5 and 10 seconds. For the metal capsules, the mercury release is obtained when the vapor pressure within the capsule increases to the bursting point of the capsule design. This can vary considerably depending on the capsule material as well as the wall thickness. Release times of about 5 seconds have been reported using stainless steel capsule of 2–3 mil wall thickness.

All of these previous methods require the use of a closed loop metal antenna to convert the RF energy to RF heating current. This adds to the expense of the lamp and limits the minimum release time since a two-stage energy conversion process is required.

DISCLOSURE OF THE INVENTION

It is, therefore, an object of the invention to obviate the disadvantages of the prior art.

It is another object of the invention to enhance mercury release within an arc discharge lamp.

Yet another object of the invention is the achievement of faster mercury release times at the expenditure of less energy.

These objects are accomplished, in one aspect of the invention, by a mercury release mechanism which includes the direct electron heating of a mercury containing target. The mercury release is accomplished after the exhaust, fill, and tip-off operations have been performed. Lamp mount modifications are employed to position the mercury containing target in an appropriate location to receive the electron stream.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
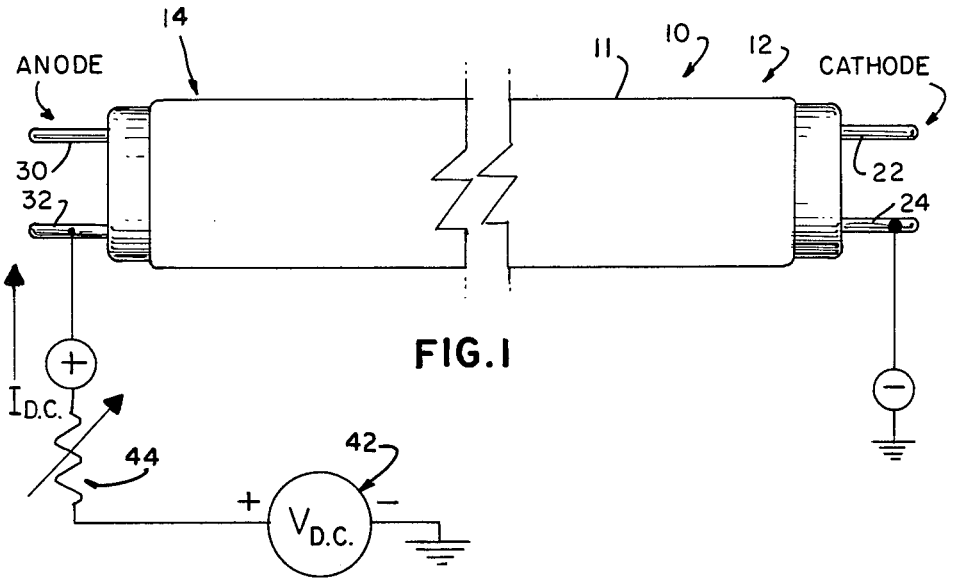
FIG. 1 is a diagrammatic view of an electrical circuit employable with the invention.

Referring now to the drawings with greater particularity, there is shown in FIG. 1 a fluorescent lamp 10 formed of a tubular glass envelope 11 and having ends 12 and 14.

Lamp 10 (see FIG. 2) has mounts 16 and 18 sealed within ends 12 and 14. Mount 16 comprises a glass stem 20, lead-in conductors 22 and 24 and an electrode 26 connected to the lead-ins and supported thereby.

Mount 18 comprises a glass stem 28, lead-in conductors 30 and 32 and an electrode 34.

A mercury containing target 36, such as a disc of $Ti_3$ Hg, is mounted upon a relatively rigid support 38 which is electrically connected to one of the lead-ins, for example, 32 of mount 18. In the embodiment shown in FIG. 2, the target 36 is positioned beyond the plane of electrode 34; i.e., toward the center of lamp 10.

Figure 3:
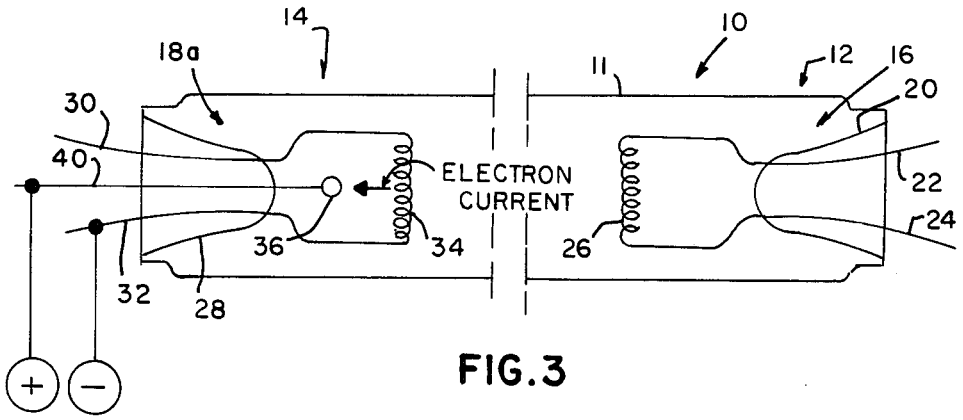
FIG. 3 is a diagrammatic view of a lamp similar to the lamp of FIG. 2 employing an alternative electrical connection.
Figure 4:
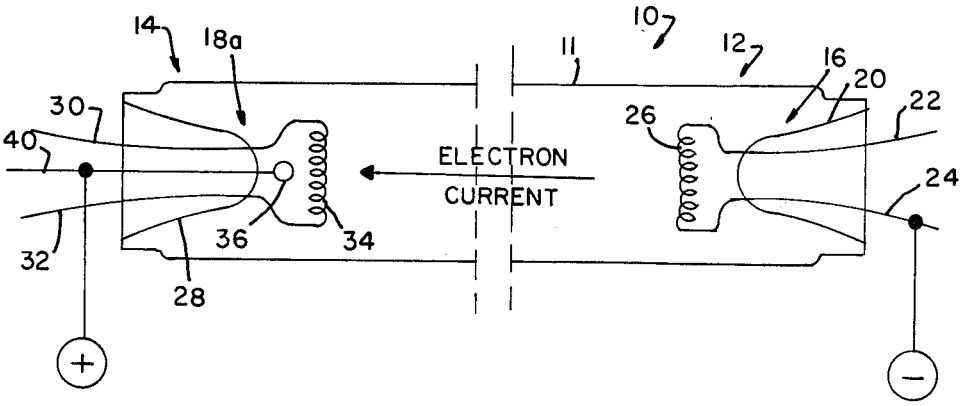
FIG. 4 is a diagrammatic view of an alternate lamp configuration with an appropriate electrical connection.

In the embodiment shown in FIGS. 3 and 4, one of the mounts, for example, 18*a*, includes a third lead-in 40 which mounts the target 36. In this instance the target 36 is positioned between electrode 34 and stem 28.

The basic circuit arrangement for utilizing electron current to release the mercury is shown in FIG. 1 as comprising a d.c. power supply 42 and a variable resistor 44. The end of the lamp 10 containing the mount to which the mercury target is attached is connected to the positive side of the power supply 42 while the other end of the lamp 10 is connected to the negative side of the power supply 42.

The current drawn through fluorescent lamp 10 is essentially electron current. The primary source of electron current in the lamp 10 is the lamp cathode which in the d.c. circuit shown is the electrode 26 connected to the negative side of the power supply 42. The primary electron current generates secondary electrons through an ionization process in the positive column of the evacuated, filled and sealed lamp. These electrons have a random thermal velocity as well as a drift velocity established by the lamp field in the direction from cathode-to-anode. Electrons arriving at the positive end of the lamp will be collected by the electrode 34, the lead-in wires, and the mercury target 36. The electron collection process converts the kinetic energy of the electron current into heat energy. The quantity of heat energy produced will depend on the kinetic energy of the electrons which is directly relatable to the anode sheath voltage. The anode sheath voltage is related to the lamp current and the electron collector surface area by equation (1).

$$V_s = \frac{KT_e}{q} \ln \frac{I_L}{J_r \cdot A_c} \quad (1)$$

where:

$V_s$=Anode sheath voltage
K=Boltzman gas constant
$T_e$=Electron gas temperature
q=Electron charge
ln=Natural logrithmic function
$I_L$=Lamp current
$J_r$=The random thermal electron current density
$A_c$=The electron collector surface area.

By increasing the lamp current and reducing the size of the collector surface, the value of the sheath voltage is increased.

The power dissipated in the anode will be equal to the product of the sheath voltage and the lamp current.

$$P = V_s I_L = \frac{KT_e}{q} I_L \ln \frac{I_L}{J_r \cdot A_c} \quad (2)$$

In using the anode heating process for mercury release, it is important that the mercury target 36 be positioned on the mount structure 18 or 18*a* in a manner which will maximize the value of heating power. This will minimize the required release time which is of critical importance in high speed lamp making equipment.

Optimum positioning of the mercury target 36 can be done by two means. The first method involves use of a three-lead-wire-mount structure, 18*a*. The mercury target 36 is attached to the isolated third lead-in wire 40 which is then connected to the positive side of the d.c. power supply. This arrangement is shown in FIGS. 3 and 4. This configuration assures that the entire electron current will be collected by the mercury target. This method will result in the fastest mercury release time for a specific activation current since *all* the current will be drawn to mercury target 36, and the collector surface area $A_c$ will be limited to that of the target 36 itself. Both these factors can be seen to increase the heating power in equation (2).

Two variations of the three-lead-wire circuit are shown in FIGS. 3 and 4. In FIG. 4 the cathode of the discharge (the electrode 26) is located at the lamp end *opposite* to the mercury target 36. In FIG. 3 the cathode is the electrode 34 which is at the *same* end of the lamp 10 as the mercury target 36.

Figure 2:
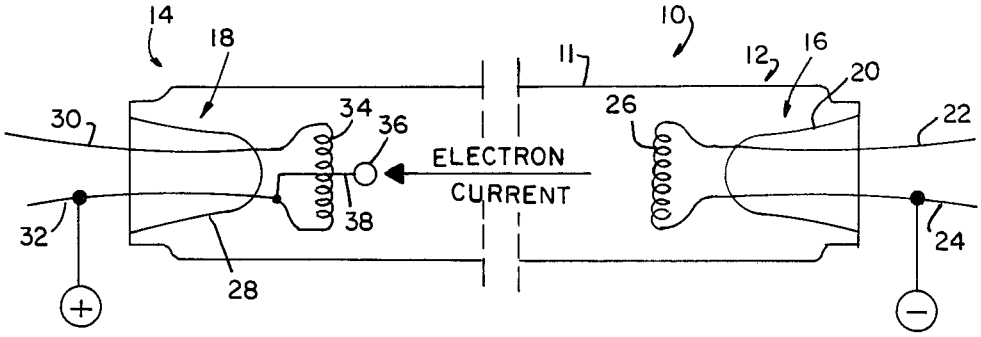
FIG. 2 is a diagrammatic view of one form of fluorescent lamp utilizing a particular electrical connection to release mercury.

FIG. 2 shows the positioning of the mercury target 36 on a standard two-lead-in mount structure 18. The target 36 is positioned above the plane of the electrode 34 and close to the electrode clamp on a lead-in wire 32. This location will result in a higher percentage of the lamp current being collected by the mercury target at the expense of the electrode 34 and lead-in wires 30 and 32. This is important if the heating power in equation (2) is to be maximized.

Activation of the mercury target 36 requires a current of between 500 to 1000 mA, depending on the size of the target 36 and the mercury release time desired. In one test of the procedure cylindrical stainless steel capsules were utilized having a wall thickness of 3 mils, a length of 160 mils, and a diameter of 22 mils. The capsules were flat on the bottom and filled with 20 mg of liquid mercury and then hermetically welded at the top end. At an activation current of 1000 mA, mercury release was accomplished in 3.5 seconds.

The target 36 also may consist of a metal capsule containing either liquid mercury, a powdered intermetallic mercury alloy, or a solid form of the mercury alloy. Alternatively, the target 36 might consist of a glass ampule containing either the liquid mercury, or a powdered or solid form of a mercury alloy. The glass ampule would be contained within a cylindrical metal holder loosely crimped at the ends or a wire-type mesh holder fashioned to hold the ampule in place. In yet another embodiment, the mercury target 36 might comprise a piece of metal ribbon onto which a mercury alloy has been applied.

While there have been shown and described what are at present considered to be the preferred embodiments of the invention, it will be apparent to those skilled in the art that various changes and modifications can be made herein without departing from the scope of the invention as defined by the appended claims.

We claim:

1. The method of releasing mercury into an arc discharge lamp having a tubular glass envelope with two ends, a mount sealed into each of said ends, each of said mounts including a glass stem having a pair of lead-in conductors sealed therein, and an electrode supported between each of said pairs of said lead-in conductors, one of said mounts having a third lead-in conductor, said method comprises the steps of positioning a mercury containing target on said third lead-in conductor within said lamp, and bombarding said target with a directed stream of electrons of sufficient energy to heat said target and release said mercury.

2. The method of claim 1 wherein said lamp contains two spaced apart electrodes; said mercury target is adjacent one of said electrodes; and the other of said electrodes is the source of said electrons.

3. The method of claim 1 wherein said lamp contains two spaced apart electrodes; and said mercury target is adjacent one of said electrodes; said adjacent electrode being the source of said electrons.

* * * * *